US005299874A

United States Patent [19]

DeVoe

[11] Patent Number: 5,299,874

[45] Date of Patent: Apr. 5, 1994

[54] AUXILIARY WEB FEEDER ATTACHMENT FOR PRINTER

[76] Inventor: John M. DeVoe, 4012 Idlewild Rd., Austin, Tex. 78731

[21] Appl. No.: 950,133

[22] Filed: Sep. 24, 1992

[51] Int. Cl.[5] ..... B41J 11/26

[52] U.S. Cl. ..... 400/613; 242/55; 242/72 R; 226/199; 211/45

[58] Field of Search ..... 400/613, 613.1, 613.2, 400/613.3, 614, 621; 226/106, 197, 198, 199; 225/106; 211/45, 47; 242/55, 58, 58.6, 68, 68.7, 72, 75.2, 79.3, 76

[56] References Cited

U.S. PATENT DOCUMENTS

| | | | |
|---|---|---|---|
| 766,804 | 8/1904 | Bellamy . | |
| 858,597 | 7/1907 | Halle . | |
| 1,124,378 | 1/1915 | Yaw . | |
| 2,512,200 | 6/1950 | Duncan | 400/613 |
| 2,890,619 | 6/1959 | Waller | 242/76 |
| 2,952,419 | 9/1960 | Allen | 242/76 |
| 3,920,136 | 11/1975 | Talbert | 242/55 |
| 3,986,594 | 10/1976 | Kondur, Jr. . | |
| 4,206,885 | 6/1980 | Salvino | 242/55 |
| 4,277,034 | 7/1981 | Buzzell | 400/68 |
| 4,773,781 | 9/1988 | Bankier | 400/613.2 |
| 4,801,021 | 1/1989 | Hassel et al. | 400/613.2 |
| 4,854,806 | 8/1989 | Gertsch et al. | 242/58.6 |
| 4,967,974 | 11/1990 | Kawamura | 242/55 |
| 5,033,881 | 7/1991 | Koike | 400/613 |

FOREIGN PATENT DOCUMENTS

| | | | |
|---|---|---|---|
| 2302244 | 7/1974 | Fed. Rep. of Germany | 226/198 |

*Primary Examiner*—Eugene H. Eickholt
*Attorney, Agent, or Firm*—Richard C. Litman

[57] ABSTRACT

An auxiliary web feeder attachment for selective alphanumeric printers includes a convex flexible flange or base which fits under and is held in position by the printer. A hollow cylinder attached to the base connects one end of a flexible steel conduit or gooseneck arm. A support shaft is attached to the other end of the flexible gooseneck arm for supporting a standard 2.5 inch wide roll of calculator or adding machine web paper. The support shaft includes a fixed first flange on one end and a removable cap having a second flange on the opposite end, the removable cap having a second flange on the opposite end, the removable flange being retained on the shaft by friction. The auxiliary web feeder attachment enables the roll of paper to be selectively moved into position to feed the web of paper to the printer when it is desired to print small messages without a substantial waste of paper. A paper clip having toothed bifurcated legs biased toward each other to grip an end of the web paper extending from the roll when the roll is moved out of web feeding position is mounted by a C-clamp on the auxiliary web feeder attachment.

8 Claims, 2 Drawing Sheets

AUXILIARY WEB FEEDER ATTACHMENT FOR PRINTER

BACKGROUND OF THE INVENTION

1. FIELD OF THE INVENTION

The present invention relates to a web feeder attachment for a selective, alphanumeric printer such as a dot matrix printer, daisy wheel printer, typewriter and the like. More specifically, this invention relates to a flexible holder for supporting a roll of standard 2.5 inch adding machine roll paper, whereby the roll paper may be selectively positioned for printing thereon when desired, and easily moved out of the way at other times.

Many selective printers are connected to and controlled by personal computers, and normally print information on fan-folded web paper perforated to provide tear-off sheets that are 8½ by 11 inches in size. Many times, however, the user may print reminder notes of only a few lines, such as an address, telephone numbers, "to-do" lists, recipes, instructions to secretaries, case citations, etc., or use the personal computer as a desk calculator, or as a label printer, resulting in a tremendous waste of paper when printing on an 8½ by 11 inch sheet of paper. This invention saves paper by enabling the easy substitution of adding machine paper for the larger size paper.

2. DESCRIPTION OF THE RELATED PRIOR ART

Structure for supporting web-paper supply rolls on a selective alphanumeric printer is well known in the prior art. U.S. Pat. No. 766,804 issued Aug. 9, 1904 to Charles J. Bellamy discloses a typewriter attachment for mounting a roll of paper on a typewriter comprising a frame with recesses for receiving the ends of a paper roll shaft, the frame having depending pegs which are inserted into hollow posts provided on the typewriter carriage, whereby the frame may be quickly removed.

U.S. Pat. No. 858,597 issued Jul. 2, 1907 to Hiram j. Halle discloses a frame permanently attached to a typewriter carriage for supporting a roll of paper.

U.S. Pat. No. 1,124,378 issued Jan. 12, 1915 to Clio B. Yaw discloses a frame secured to a fixed portion of a combined typewriter, which frame supports a roll of adding machine paper to be used by the combined typewriter and adding machine.

U.S. Pat. No. 3,986,594 issued Oct. 19, 1976 to Nicholas Kondur, Jr. discloses a fixed frame for supporting a roll of paper for use with a matrix print head mounted on a shiftable carriage.

As will be seen, none of the above cited patents, taken alone or in combination, disclose the invention described below and in the appended claims.

SUMMARY AND OBJECTS OF THE INVENTION

The present invention comprises a flexible base designed to rest under and to be held by the housing of a conventional selective printer. The base, shown as being flat in FIG. 1, may be bent in alternative directions as shown in FIGS. 4 and 5, have a concave configuration as shown in FIG. 6, or have a convex configuration as shown in FIG. 7. These configurations help to hold the attachment in position relative to the printer housing, and are pressed flat by the printer housing. Attached to the base is a flexible gooseneck tubing which may be shifted to different positions relative to the base. Attached to the end of the tubing opposite to the base is a shaft for supporting a roll of adding machine paper. The shaft has an integral flange at the end attached to the flexible tubing, and a removable flange at the opposite end of the shaft, whereby a roll of adding machine paper may be mounted on the shaft and retained in position by the respective flanges. In use, the adding machine paper may be positioned to be fed around the platen of the selective printer when it is desired to print a small message, or alternatively, may be positioned in a non-interfering location by means of a suitably mounted clip, and enable the feed of conventional 8½ by 11 inch web paper to the printer by merely pushing the shaft and paper roll to one side.

It is an object of this invention to provide a flexible attachment for supporting a roll of adding machine paper for selective use with a printer.

It is another object of this invention to provide a flexible, bendable tube for supporting a roll of adding machine paper in proximity to a selective printer.

It is a further object of this invention to retain a flexible support for a roll of adding machine paper in position relative to a selective printer by providing a flexible base held by the weight of the selective printer.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of being carried out in various ways. Also, it is to be understood that the phraseology and terminology employed herein is for the purpose of description and not limitation.

Figure 1:
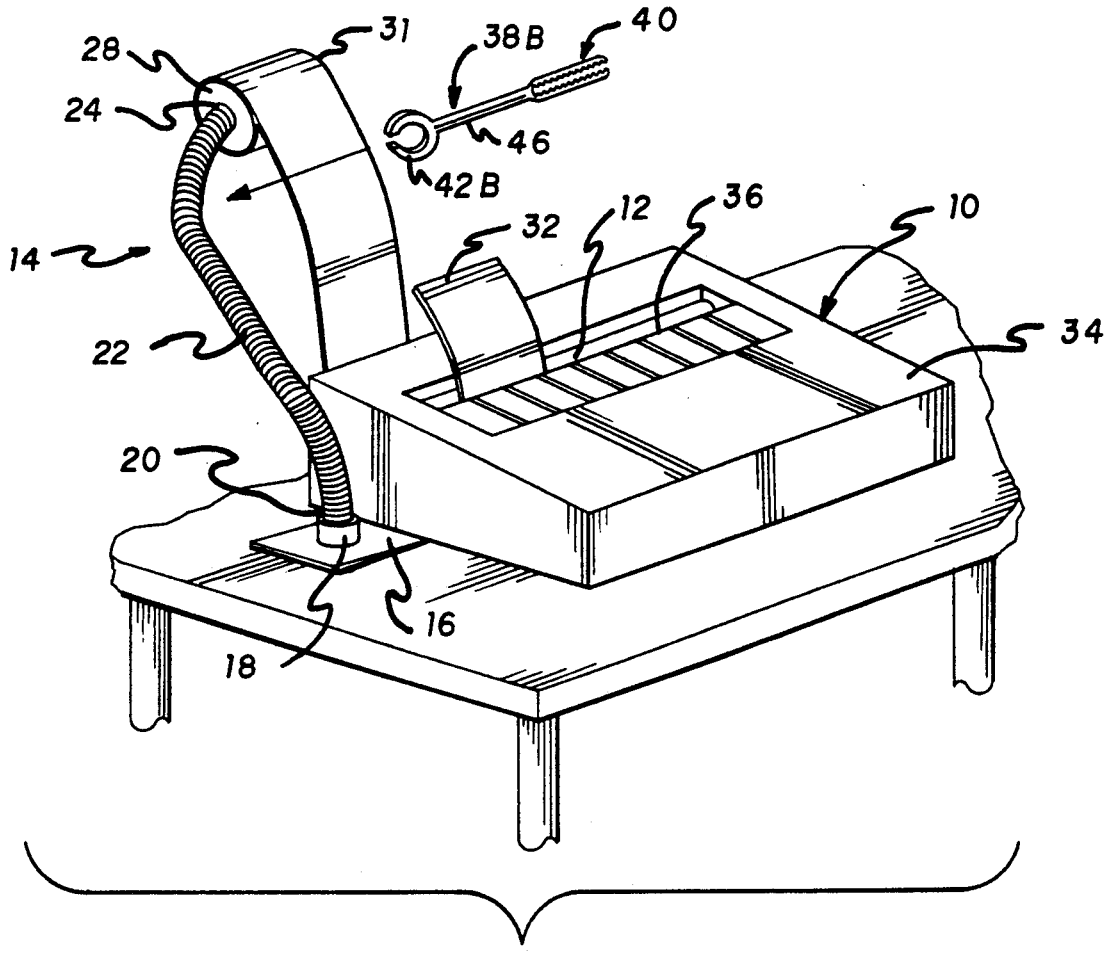
FIG. 1 is an environmental perspective view showing the flexible paper support positioned for use with a selective printer, together with a suitable clip for holding web paper in a non-interfering position.

Turning now to FIG. 1, there is shown a conventional selective printer 10 which may be a dot matrix or a daisy wheel printer. Normally, printer 10 uses a fan folded web paper (not shown) which may be fed either by conventional friction rollers or by conventional pin wheels around a platen 12, the web paper being perforated so as to provide individual sheets having dimensions of 8½ by 11 inches. This constitutes a waste of paper when only a few lines are to be printed.

Figure 4:
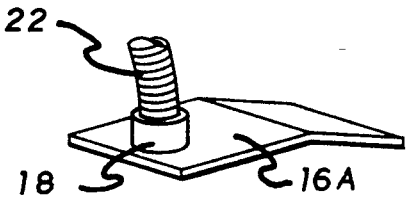
FIGS. 4, 5, 6 and 7 show different configurations of a flexible base plate, which configurations enable better and more secure contact with the housing of a selective printer.
Figure 5:
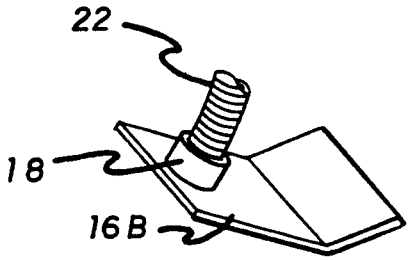
Figure 6:
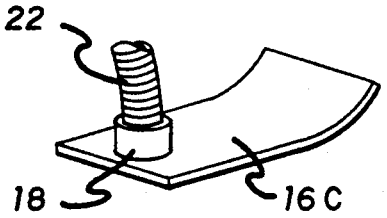
Figure 7:
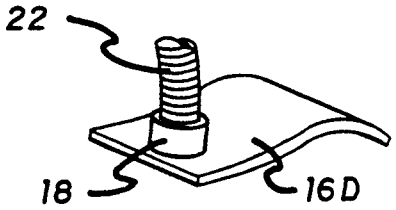

The web feeder attachment 14 shown in FIG. 1 enables the user to selectively print a small message without wasting a substantial amount of time. Attachment 14 includes a flexible base plate 16 located beneath and held in position by selective printer 10. Base plate 16 may be formed of steel or plastic material, and may have a variety of configurations as shown in FIGS. 4–7. In FIG. 4, base plate 16A is shown with a downward bend, while in FIG. 5, base plate 16B is shown with an upwardly directed bend. In FIG. 6, plate 16C is provided with a concave configuration, while in FIG. 7, plate 16D is provided with a convex configuration. Base plates 16A–16D are pressed flat by the weight of the selective printer housing 34. Connected to base plate 16 is a hollow cylinder 18 for receiving one end 20 of a flexible jointed steel conduit or gooseneck arm 22. Attached to the other end 24 of gooseneck arm 22 is a plastic cylinder or support shaft 26 having a fixed plastic flange 28 and a removable plastic flange 30, best shown in FIG. 2. Flange 28 is provided with a bore 28A for receiving end 24 of gooseneck arm 22 therethrough, end 24 being retained in support shaft 26 by any suitable means. The distance between flanges 28 and 30 is approximately 2.5 inches, enabling a roll 31 of standard 2.5 inch adding machine roll of paper 32 to be mounted on the support shaft 26, paper 32 then being guided around platen 12. The removable flange 30 is part of an end cap 29 held in position on support shaft 26 by friction, thereby enabling the flanges 28, 30 to hold roll 31 in place.

Figure 3:
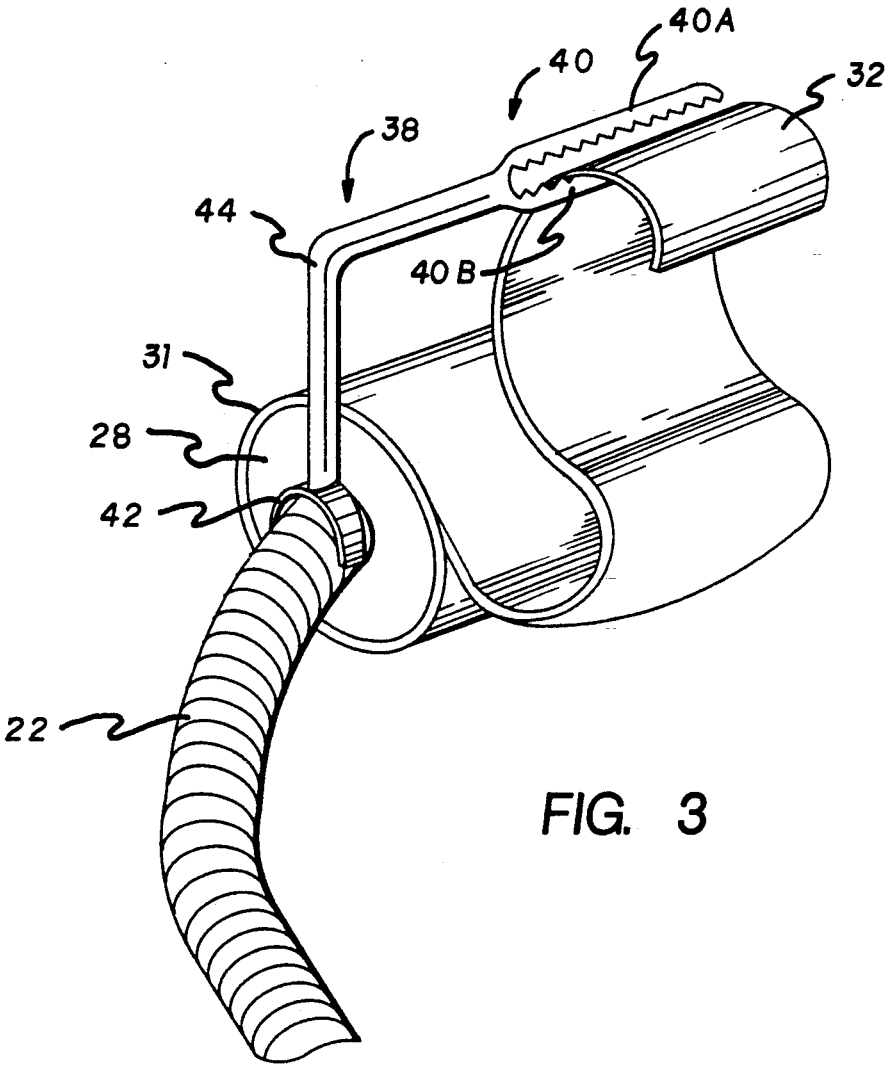
FIG. 3 is a perspective view showing how a suitably mounted paper clip holds the web paper in a non-interfering position.

Gooseneck arm 22 is bendable, and when bent will remain in the new position, thereby enabling paper 32 to be moved into and out of paper feeding position relative to a printer 10. When it is desired to print a short message or a series of short messages, the conventional fan-folded web (not shown) may be removed from printer 10, and gooseneck arm 22 is then bent to move roll 31 into position to enable paper 32 to be fed around platen 12. Normally, conventional printers such as printer 10 are provided With a housing 34 having a tear bar or cutting edge 36 whereby printed messages may be separated from paper 32. When the user is finished printing such messages, roll 31 may be pushed out of the way because of the flexibility of arm 22, and the conventional full sized web paper can be reintroduced around platen 12 without difficulty. As shown in FIG. 3, the end of paper 32 may be held in a suitable clip 38 attached to the end 24 of gooseneck arm 22 when roll 31 is pushed out of the way to prevent the end of paper 32 from dangling or unrolling from roll 31. While the bifurcated end 40 of clip 38 is shown to be open, toothed legs 40A, 40B may be biased towards one another to clamp paper 32 therebetween.

Clip 38 is provided with an L-shaped bar 44, and a C-clamp 42 at the mounting end configured to be mounted on the end 24 of gooseneck arm 22 or alternatively on an external collar (not shown) provided on flange 28.

Figure 2:
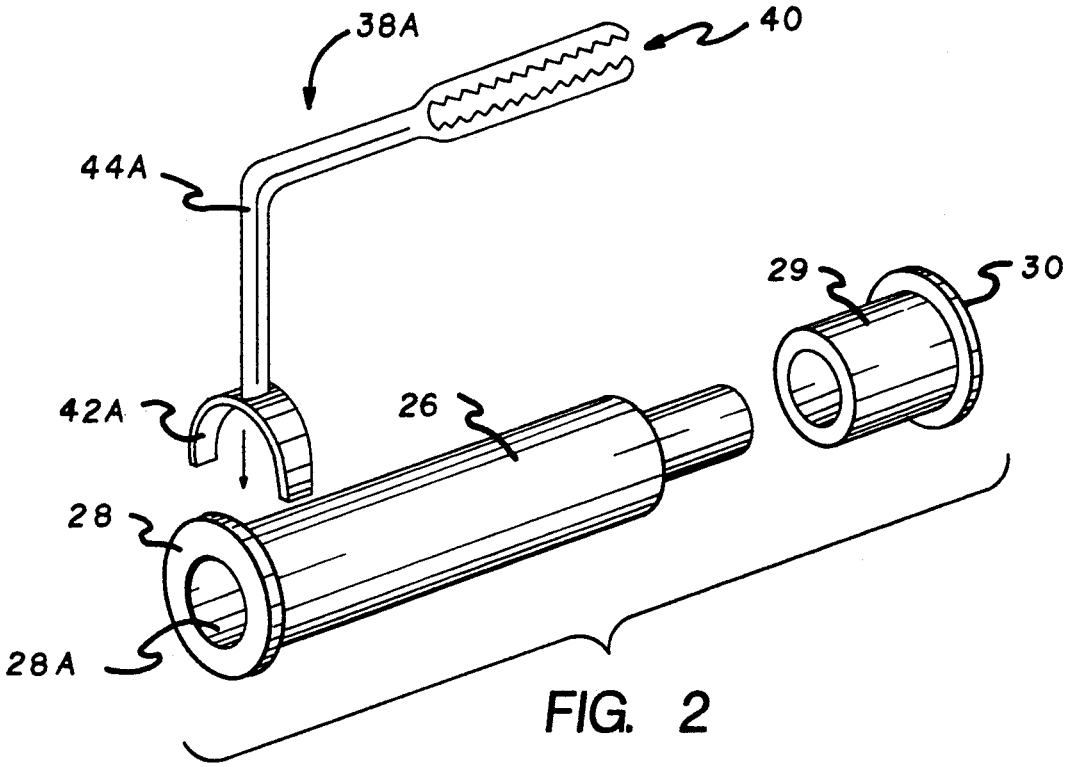
FIG. 2 is a perspective view of the support shaft for a roll of adding machine paper, together with another suitable clip for holding web paper in a non-interfering position.

As shown in FIG. 2, clip 38A is provided with an L-shaped bar 44A and a C-clamp 42A shown to be mountable directly on shaft 26 on the side of flange 28 facing roll 31. In FIG. 1, clip 38B is provided with a straight bar 46 and a C-clamp 42B configured to be mountable on gooseneck arm 22 between ends 20 and 24.

Many computer programs, for example, Sidekick, Info Select, MemoryMate, Agenda, etc., use or incorporate the metaphor of a note pad. These programs present a screen image of a compact window of about twenty characters by ten lines. The user can draft lists, addresses, or brief reminder notes into this window. The notes can accompany a full-screen document or reside in memory to be called up on command. Each of these programs has a print function, but printing until now is usually done on a standard 8½ by 11 inch sheet of paper. Printing out an address on a dot matrix printer until now has meant tearing off the top corner of a full sheet of paper, which wastes the page. The rest of the page usually stays in the printer, ready to become the first page of a formal document, which then must be reprinted on a new page. The auxiliary paper web 32 provided by this invention enables the note pad format to be carried through to the printed document, and the non-perforated paper 32 can be taken off close to the end of the printed text.

With the web feeder attachment of this invention, messages shorter than a single page of correspondence can be economically printed. Software calculators such as those incorporated in PC Tools and Sidekick can be turned into printing calculators that generate the same tapes as electronic adding machines, thus moving one more device off of the typical desk. In small offices without networks or E-mail systems, the web feeder attachment of this invention makes it easy to print out a message from one computer and carry it to a colleague down the hall without manually copying it from the screen. Pages from calendar programs can be printed and attached to deposition notes, making it possible to question a witness about activities on dates in the past.

If a user has two selective printers 10, a selector switch (not shown) or a second parallel port would enable both printers to be connected to the same computer, with one printer dedicated to the use of small paper rolls 31 for short messages. Alternatively, a single selective printer 10 with paper parking, allowing friction-feed to be used without unloading tractor-feed paper, could be used for both tractor-feed paper and roll paper 32.

While it will be apparent that the preferred embodiment herein disclosed is well calculated to fulfill the objects above stated, it will be appreciated that the invention is susceptible to modification, variation and change without departing from the proper scope or fair meaning of the subjoined claims.

I claim:

1. An auxiliary web feeder for a printer comprising:

a base plate means for supporting the web feeder attachment adjacent said printer, said base plate means having a non-planar configuration disposed beneath and held in position by said printer;

a flexible arm means connected at one end to said base plate means; and a support shaft means connected to a second end of said arm means for receiving an auxiliary paper web roll; whereby said auxiliary paper web roll may be selectively moved into position to feed an auxiliary paper web to said printer to enable said printer to print short messages while conserving paper.

2. An auxiliary web feeder attachment as in claim 1, wherein said base plate means comprises a bent flexible plastic flange disposed beneath and held in position by said printer.

3. An auxiliary web feeder attachment as in claim 1, wherein said base plate means comprises a bent flexible steel flange disposed beneath and held in position by said printer.

4. An auxiliary web feeder attachment as in claim 2, further comprising:

a cylindrical cup attached to said flange for receiving said one end of said flexible arm means; and said flexible arm means being formed of a flexible steel gooseneck; whereby said flexible arm means may be moved to and retained in a plurality of positions.

5. An auxiliary web feeder attachment as in claim 3, further comprising:

a cylindrical cup attached to said flange for receiving said one end of said flexible arm means; and said flexible arm means being formed of a flexible steel gooseneck; whereby said flexible arm means may be moved to and retained in a plurality of positions.

6. An auxiliary web feeder attachment as in claim 1, further comprising:

a clip mounted on said attachment for holding an end of said auxiliary paper web extending from said paper web roll in a non-interfering position when said paper web roll is moved away from said feed position.

7. An auxiliary web feeder attachment as in claim 6, said clip comprising:

toothed bifurcated legs at one end biased toward a position to grip said auxiliary paper web; and a C-clamp for clamping said flexible arm means at an end opposite said one end; whereby said clip may be mounted on said web feeder attachment.

8. An auxiliary web feeder attachment as in claim 6, said clip comprising:

toothed bifurcated legs at one end biased toward a position to grip said auxiliary paper web; and a C-clamp for clamping said support shaft means at an end opposite said one end; whereby said clip may be mounted on said web feeder attachment.

* * * * *